US011268501B1

(12) United States Patent
Martin

(10) Patent No.: US 11,268,501 B1
(45) Date of Patent: Mar. 8, 2022

(54) HYDRAULIC SYSTEM FOR HIGH SPEED RECIPROCATING CYLINDERS

(71) Applicant: Hydraquip, Inc., Houston, TX (US)

(72) Inventor: Eric Wayne Martin, The Woodlands, TX (US)

(73) Assignee: Hydraquip, Inc., Houston, TX (US)

( * ) Notice: Subject to any disclaimer, the term of this patent is extended or adjusted under 35 U.S.C. 154(b) by 34 days.

(21) Appl. No.: 16/891,890

(22) Filed: Jun. 3, 2020

Related U.S. Application Data

(60) Provisional application No. 62/856,929, filed on Jun. 4, 2019.

(51) Int. Cl.

| | |
|---|---|
| ***F04B 9/103*** | (2006.01) |
| ***F04B 47/04*** | (2006.01) |
| ***F04B 23/06*** | (2006.01) |
| ***F04B 9/105*** | (2006.01) |
| ***F04B 11/00*** | (2006.01) |
| ***F04B 23/02*** | (2006.01) |

(52) U.S. Cl.
CPC ..... *F04B 9/103* (2013.01); *F04B 9/1053* (2013.01); *F04B 11/0058* (2013.01); *F04B 23/02* (2013.01); *F04B 23/06* (2013.01); *F04B 47/04* (2013.01)

(58) Field of Classification Search
CPC ..... F04B 9/1053; F04B 9/103; F04B 9/105; F04B 114/005; F04B 11/0041; F04B 11/0058; F04B 23/02; F04B 23/06; F04B 47/04; F04B 11/0008–11/0025; F04B 9/10; F04B 9/109; F04B 9/1095; F04B 9/111; F04B 9/113; F15B 1/02–1/045; F15B 15/18; F15B 11/08; F15B 2211/20; F15B 2211/205; F15B 2211/20561; F15B 2211/21; F15B 2211/212
USPC ..... 417/379, 390
See application file for complete search history.

(56) References Cited

U.S. PATENT DOCUMENTS

| | | | | |
|---|---|---|---|---|
| 2006/0070378 | A1* | 4/2006 | Geiger | B29C 45/67 60/475 |
| 2009/0120084 | A1* | 5/2009 | Baltes | E02F 9/2217 60/414 |
| 2011/0123363 | A1* | 5/2011 | Marica | F04B 5/00 417/279 |
| 2015/0192117 | A1* | 7/2015 | Bridges | F04B 17/05 417/53 |

(Continued)

*Primary Examiner* — Bryan M Lettman
(74) *Attorney, Agent, or Firm* — Vorys, Sater, Seymour and Pease LLP

(57) ABSTRACT

A closed-loop hydraulic circuit includes a piston chamber housing a piston rod and a ram piston coupled to an end of the piston rod, and a pump in fluid communication with the piston chamber at first and second hydraulic ports. Pumping a hydraulic fluid to the first hydraulic port causes a forward stroke of the ram piston and the piston rod, and pumping the hydraulic fluid to the second hydraulic port causes a return stroke of the ram piston and the piston rod within the piston chamber. An accumulator is in fluid communication with the pump and the piston chamber, and a 3-2 valve is actuatable between a first position, where pressurized hydraulic fluid is conveyed from the accumulator to the pump during the forward stroke, and a second position, where excess hydraulic fluid is conveyed from the first hydraulic port to the accumulator during the return stroke.

20 Claims, 6 Drawing Sheets

(56) References Cited

U.S. PATENT DOCUMENTS

2018/0266412 A1* 9/2018 Stokkev ..... F04B 49/08
2019/0330923 A1* 10/2019 Gable ..... E21B 4/14

* cited by examiner

HYDRAULIC SYSTEM FOR HIGH SPEED RECIPROCATING CYLINDERS

BACKGROUND

To enhance or ensure effective hydrocarbon production, oil and gas wells typically require various downhole services such as hydraulic fracturing, acidizing, cementing, sand control, well control, and fluid circulation operations. Each of these services requires one or more pumps suitable for conveying (pumping) a fluid into the well. One common type of pump used in the oil and gas industry is a linear reciprocating, plunger-type pump, commonly referred to as a "frac pump." Some frac pumps include one or more piston and cylinder assemblies powered by a hydraulic circuit. The hydraulic circuit facilitates and regulates the forward and return strokes of the piston within the cylinder. Reciprocation of the piston (alternately referred to as a "plunger") within the cylinder repeatedly draws in a working fluid during the return stroke, and pressurizes the working fluid during the forward stroke. The pressurized working fluid is then discharged via a manifold fluidly coupled to the well.

The goal for the pumping application is to achieve the highest flow possible, while maintaining a laminar flow profile that provides a constant flow rate. Consequently, the objective of the hydraulic circuit is to provide the fastest and most accurate motion control of the piston within the cylinder. The precision level of piston position and control achieved is directly proportional to the level of laminar flow rate achieved, and is also directly proportional to the degree of reduced flow fluctuations and pressure pulses. The faster the piston moves, the higher the flow rate that is achieved.

Both high speed and an optimized level of control are desired for the hydraulic system. For this and other reasons, a need continues to exist for improvements in hydraulic circuits used in well servicing pumps.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present invention relates generally to pumping assemblies used for well servicing applications and, more particularly, to hydraulic circuits used to power piston cylinder assemblies used in well service pump system assemblies.

Embodiments of the present disclosure describe a closed-loop hydraulic circuit that can be used in conjunction with a well service pump system or another type of pumping system that requires high-pressure pumping operations. One example hydraulic circuit includes a piston chamber that houses a piston rod and a ram piston coupled to an end of the piston rod. A pump is in fluid communication with the piston chamber at first and second hydraulic ports, whereby pumping a hydraulic fluid to the first hydraulic port causes a forward stroke of the ram piston and the piston rod, and pumping the hydraulic fluid to the second hydraulic port causes a return stroke of the ram piston and the piston rod within the piston chamber. An accumulator is in fluid communication with the pump and the piston chamber, and a 3-2 valve is actuatable between a first position, where pressurized hydraulic fluid is conveyed from the accumulator to the pump during the forward stroke, and a second position, where excess hydraulic fluid is conveyed from the first hydraulic port to the accumulator during the return stroke.

Figure 1A:
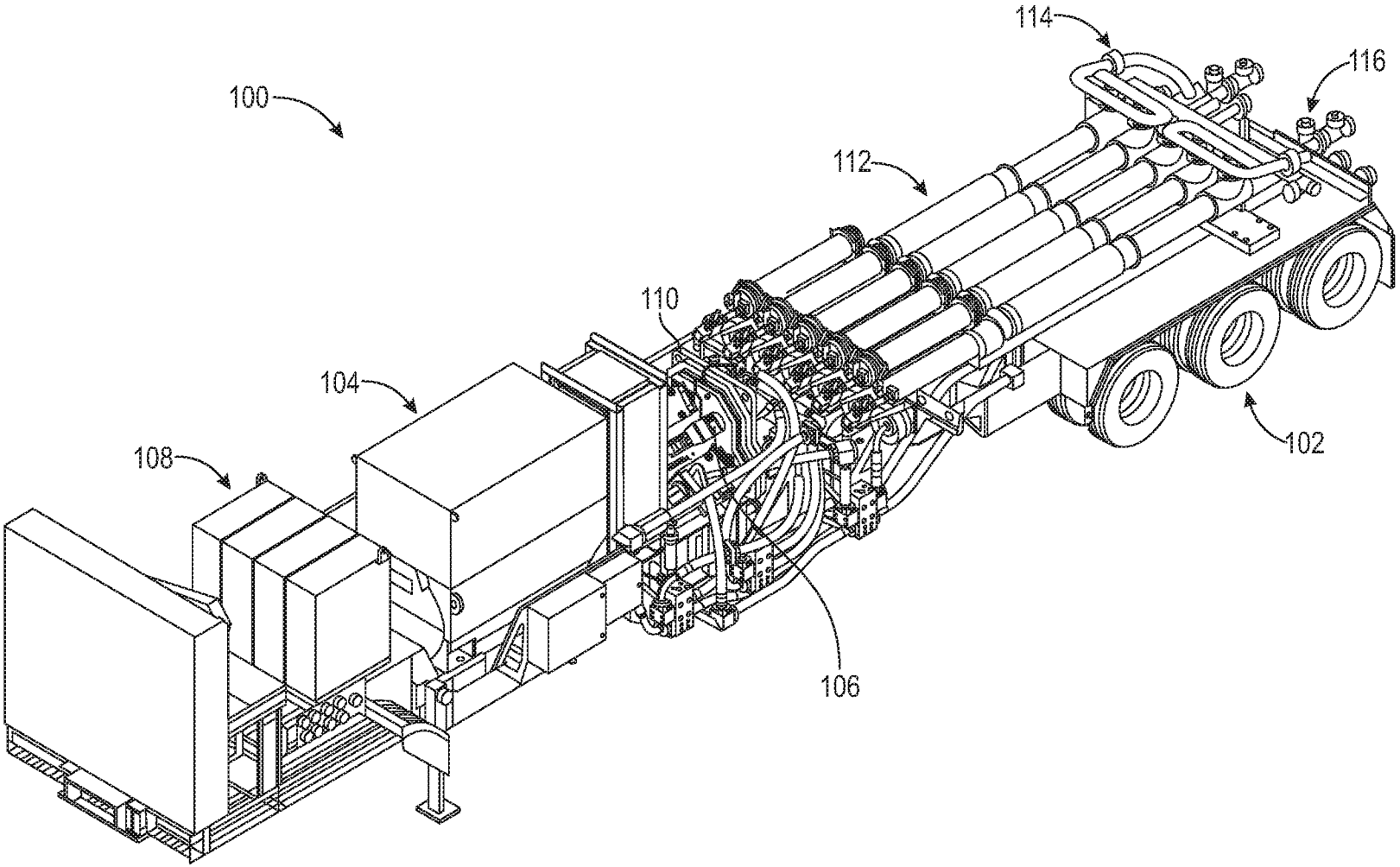
FIGS. 1A and 1B are isometric front and back views, respectively, of an example well service pump system that may incorporate the principles of the present disclosure.
Figure 1B:
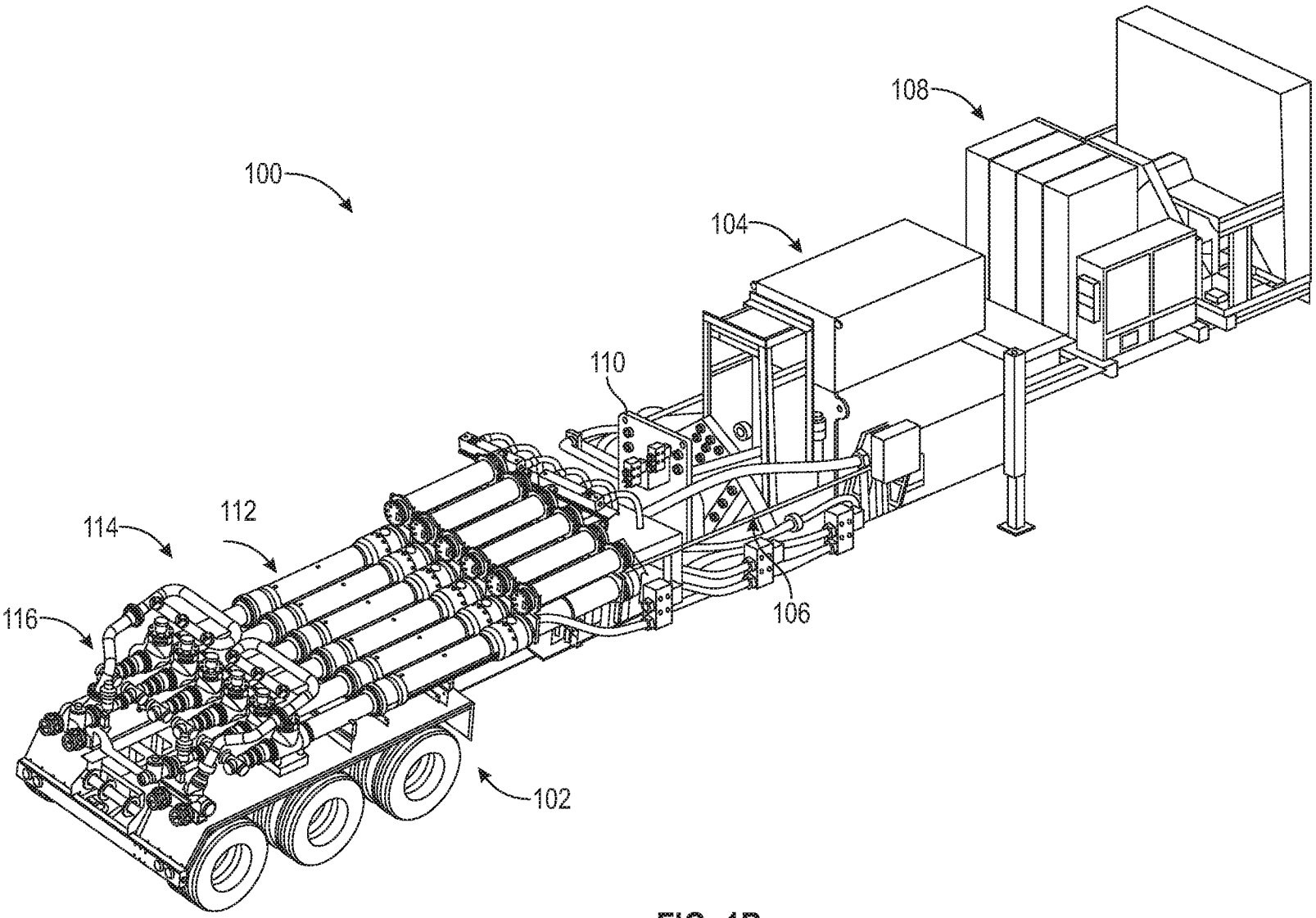

FIGS. 1A and 1B are isometric front and back views, respectively, of an example well service pump system 100 that may incorporate the principles of the present disclosure. The well service pump system 100 (referred to hereafter as "the pump system 100") may alternately be referred to as a "frac" pump and may be designed to deliver a working fluid at high pressure to a well (not shown) associated with the production of hydrocarbons. However, those skilled in the art will readily appreciate that the principles of the present disclosure and are equally applicable in other industries. For example, the hydraulic circuits described herein may alternately be applied to any industry or application that requires piston/cylinder assemblies to pump a fluid at high pressure. In particular, the hydraulic circuits described herein may be applicable to any application that requires pumping of highly viscous or highly corrosive working fluids and/or applications that require laminar flow. One example application is injection molding, which commonly requires laminar flow at a constant rate and constant pressure.

In some embodiments, as illustrated, the pump system 100 may be mounted to and otherwise supported by a trailer 102. In other embodiments, however, the pump system 100 may instead be mounted to a skid frame that can be loaded and offloaded from a vehicle, such as a trailer or the like. The pump system 100 includes a motor 104 configured to drive one or more hydraulic pumps 106 that direct hydraulic fluid, as described in further detail below. The motor 104 can include any type of prime mover capable of providing mechanical energy, such as a diesel engine, a gasoline engine, a natural gas engine, an electric motor, a gas turbine, or any combination thereof. The pump system 100 may include one or more hydraulic fluid reservoirs 108 in fluid communication with at least one of the pumps 106 to compensate for leakage and/or other operational losses of hydraulic fluid in the system. As described in more detail below, the pump system 100 may incorporate a discrete and segregated hydraulic fluid reservoir 108 for each pump 106, thus providing multiple closed-loop hydraulic circuits.

The pump system 100 includes a pump drive 110 coupled to the motor 104 and operatively coupled to each pump 106. The pump drive 110 is configured to transfer mechanical energy from the motor 104 to each pump 106, one at a time, or two or more at a time.

The pump system 100 also includes a plurality of working pump assemblies 112, each of which are coupled to and actuatable by one of the pumps 106 to deliver working fluid at high pressure to an adjacent well. The pump system 100 can include any suitable number of working pump assemblies 112, such as two, three, four, five, six, seven, eight, nine, or ten assemblies, or more. The pump system 100 also includes a suction manifold 114 and a discharge manifold 116 fluidly coupled to each working pump assembly 112. The suction manifold 114 distributes a working fluid to each working pump assembly 112 in parallel, and the discharge manifold 116 receives compressed working fluid from each working pump assembly 112 in parallel for delivering the compressed working fluid to the well. In at least one embodiment, the working fluid compressed by the working pump assemblies 112 is a hydraulic fracturing fluid, but could alternatively be another type of working fluid, without departing from the scope of the disclosure.

Figure 2B:
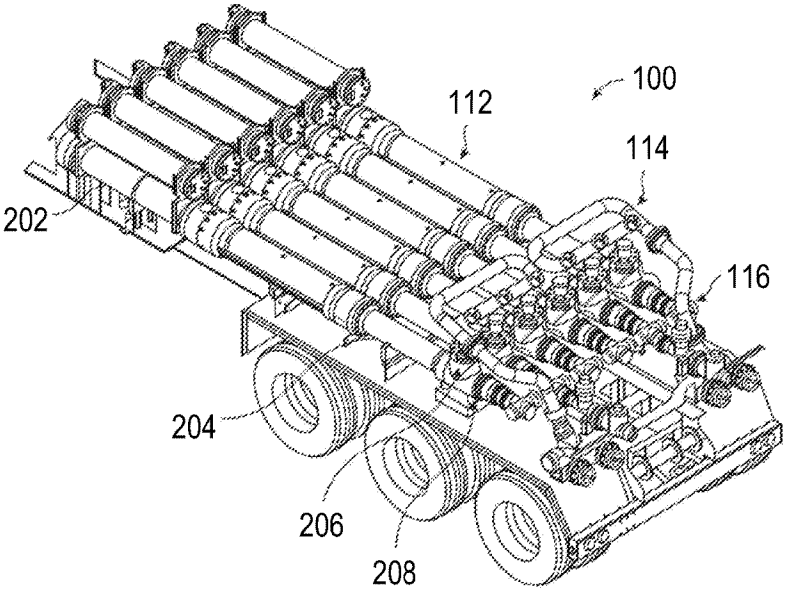
FIGS. 2A and 2B are front and back isometric views, respectively, of the working pump assemblies of FIGS. 1A-1B.
Figure 2A:
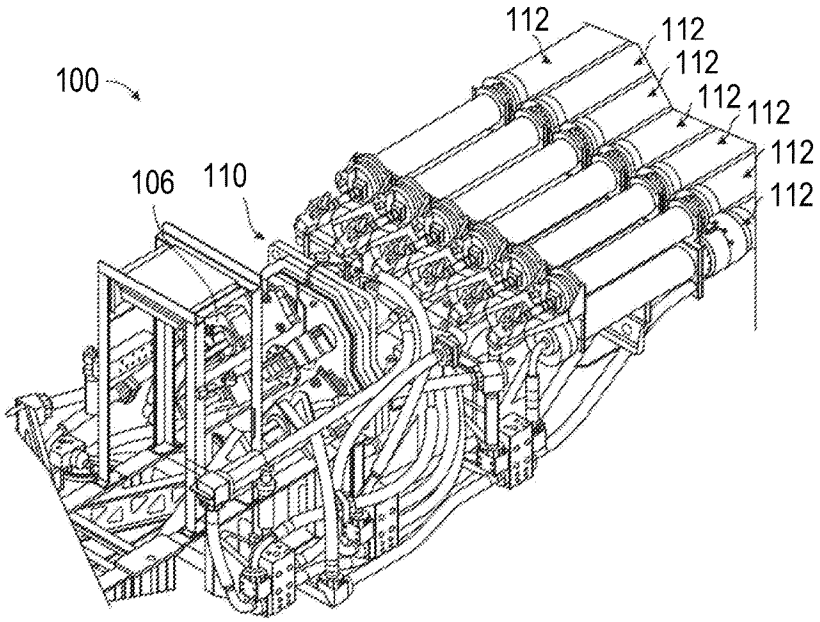

FIGS. 2A and 2B are enlarged front and back isometric views, respectively, of the working pump assemblies 112 generally described above. Similar reference numerals used in FIGS. 1A-1B represent similar components of the pump system 100 that will not be described again in detail. As best seen in FIG. 2B, each working pump assembly 112 may include a hydraulic ram cylinder 202 and a working fluid end cylinder 204. Working fluid is drawn into the working fluid end cylinder 204 via an inlet 206, and compressed working fluid is discharged from the working fluid end cylinder 204 to the well via an outlet 208.

Figure 3:
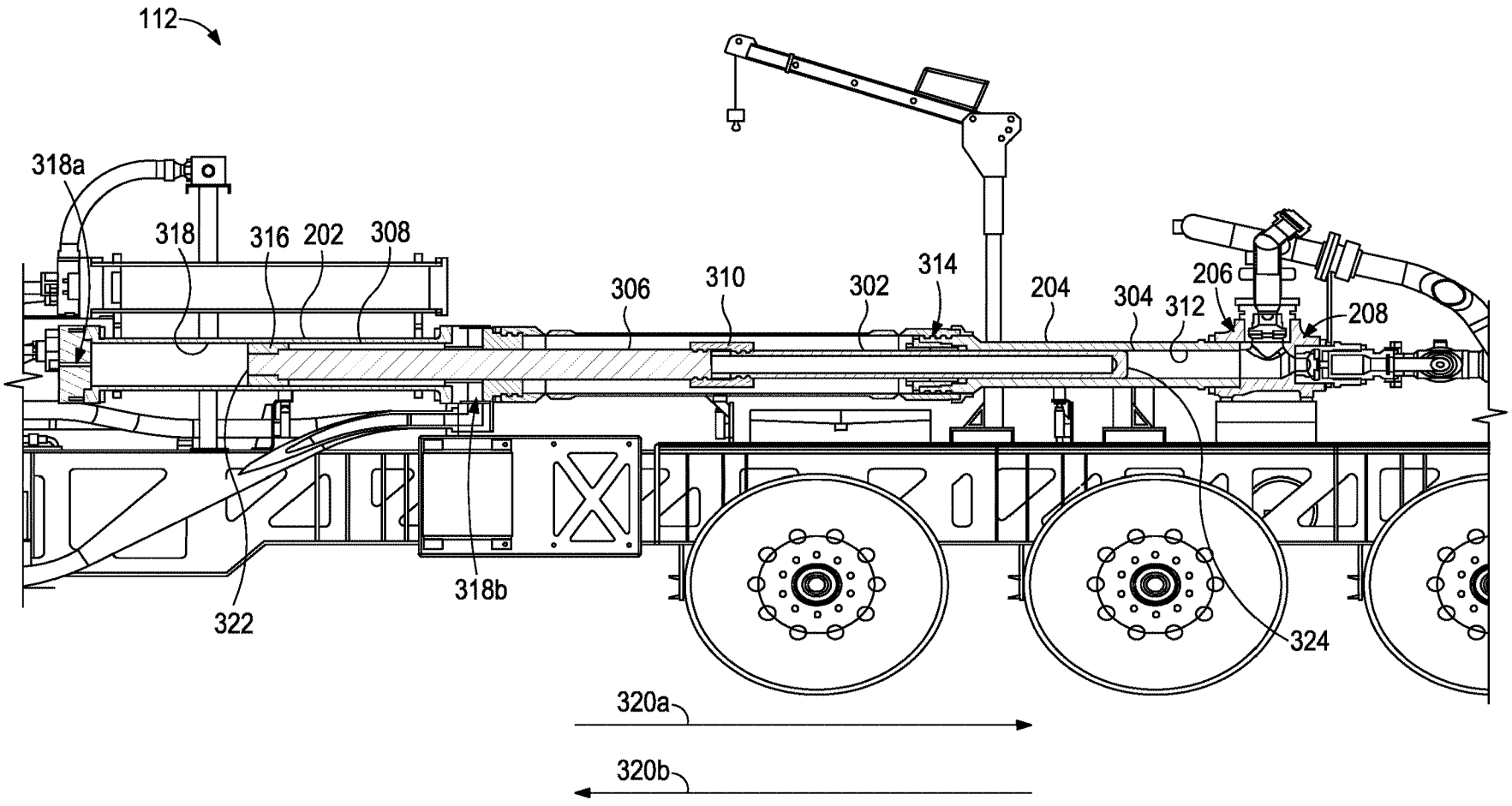
FIG. 3 is an enlarged partial cross-sectional side view of one of the working pump assemblies of FIGS. 1A-1B or 2A-2B.

FIG. 3 is an enlarged partial cross-sectional side view of one of the working pump assemblies 112. As illustrated, the working fluid end cylinder 204 includes a plunger rod 302 disposed within a plunger chamber 304 defined by the working fluid end cylinder 204. The plunger rod 302 is operable to reciprocate within the plunger chamber 304 to draw in working fluid into the working fluid end cylinder 204 via the inlet 206 and expel working fluid under high pressure to the well via the outlet 208.

The hydraulic ram cylinder 202 has a piston rod 306 disposed within a piston chamber 308 defined by the hydraulic ram cylinder 202. The piston rod 306 is coupled to the plunger rod 302 to actuate the plunger rod 302 and supply the working fluid under pressure. A coupling member 310 operatively couples the piston rod 306 to the plunger rod 302 such that linear and/or rotational movement of the piston rod 306 causes a matching linear and/or rotational movement of the plunger rod 302.

The plunger rod 302 has an outer diameter that is smaller than an inner wall 312 of the working fluid end cylinder 204. The plunger rod 302 is sealed within the working fluid end cylinder 204 by an end seal 314 that provides a tight seal around an outer surface of the plunger rod 302 and assists with maintaining alignment of the plunger rod 302 relative to the working fluid end cylinder 204. The maximum length of the plunger rod 302 that extends into the plunger chamber 304 of fluid end cylinder 204 is termed the "stroke length" of the plunger rod 302.

A ram piston 316 is coupled to or forms part of the piston rod 306 within the hydraulic ram cylinder 202. The ram piston 316 exhibits an outer diameter that fits closely and in a substantially sealed relationship with an inner wall 318 of the hydraulic ram cylinder 202. The ram piston 316 is actuatable to reciprocate within the ram cylinder 202 such that the ram piston 316 causes the plunger rod 302 to correspondingly move within the fluid end cylinder 204.

As illustrated, the ram cylinder 202 includes a first hydraulic port 318*a* arranged on a first side of the ram piston 316 and a second hydraulic port 318*b* on a second side of the ram piston 316. Each hydraulic port 318*a,b* is configured to receive hydraulic fluid from a corresponding pump 106 (FIGS. 1A-1B and 2A) to actuate the ram piston 316 and correspondingly move the plunger rod 302. More specifically, hydraulic fluid may be received at the first hydraulic port 318*a* to move the plunger rod 302 in a first direction 320*a* to compress and expel working fluid from the working fluid end cylinder 204 during a forward stroke of the plunger rod 302. In contrast, hydraulic fluid may be received at the second hydraulic port 318*b* to move the plunger rod 302 in a second direction 320*b* to draw working fluid into the working fluid end cylinder 204 during a return stroke of the plunger rod 302.

The ram piston 316 has a piston surface area 322 upon which hydraulic fluid in the piston chamber 308 acts to move the ram piston 316 in the first direction 320*a*. In contrast, the plunger rod 302 has a piston surface area 324 upon which working fluid in the plunger chamber 304 can act to help move the plunger rod 302 in the second direction 320*b*. The piston surface area 322 of the ram piston 316 is greater than the piston surface area 324 of the plunger rod 302, such as approximately two or more times greater.

Figure 4:
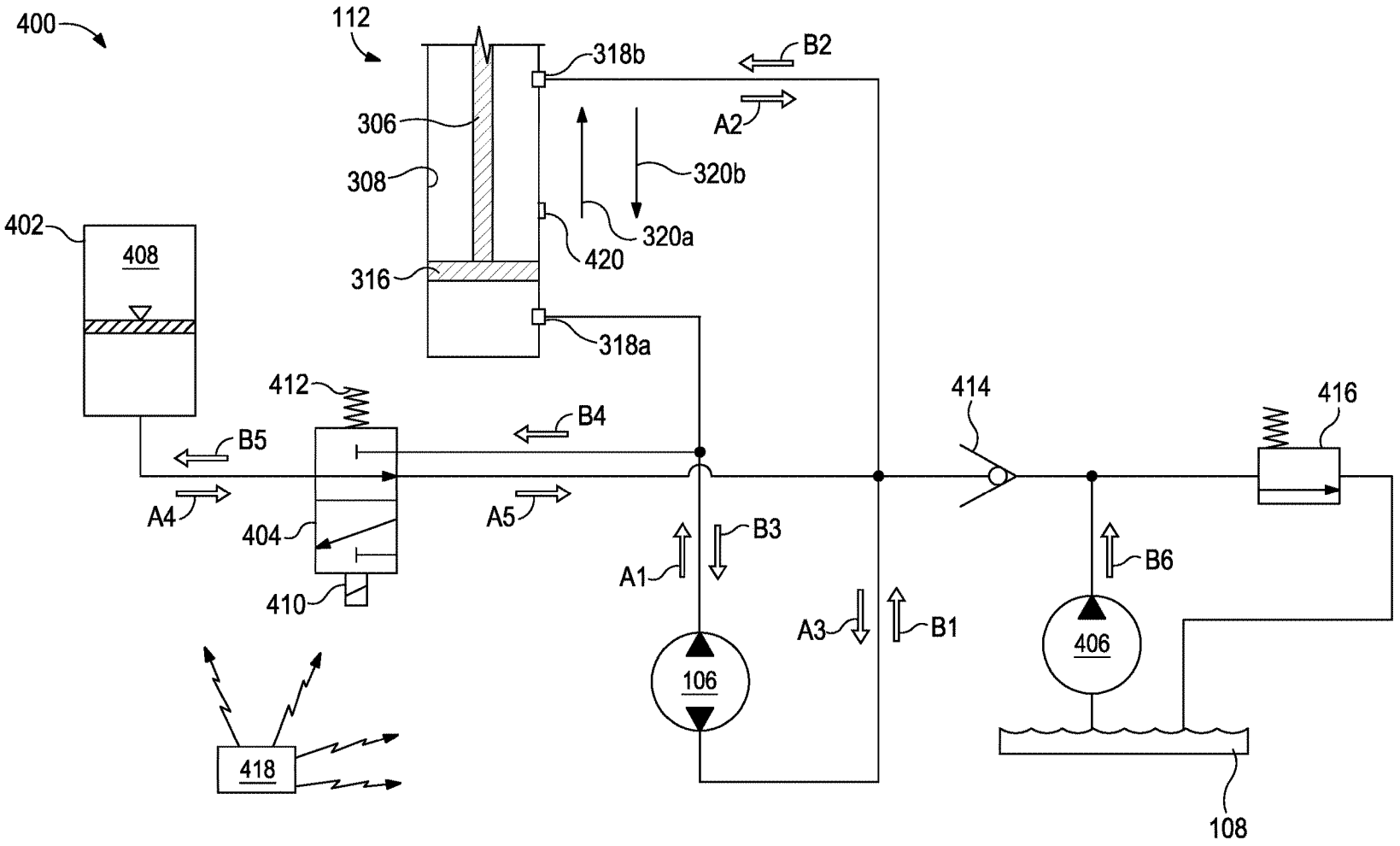
FIG. 4 is a schematic diagram of an example hydraulic circuit that may be used to actuate the working pump assembly of FIG. 3.

FIG. 4 is a schematic diagram of an example hydraulic circuit 400 that may be operable to actuate one of the working pump assemblies 112, according to one or more embodiments of the present disclosure. The hydraulic circuit 400 is a closed-loop hydraulic circuit that includes at least one of the pumps 106, which is operated to actuate the working pump assembly 112. More specifically, the pump 106 is operated to cause the ram piston 316 and the interconnected piston rod 306 to reciprocate within the piston chamber 308 across forward and return strokes, and correspondingly cause the interconnected plunger rod 302 (FIG. 3) to simultaneously reciprocate within the plunger chamber 304 (FIG. 3) to receive, compress, and discharge the working fluid. The pump 106 may comprise a variable displacement pump that crosses over center to change actuation direction of the ram piston 316 and the piston rod 306.

As illustrated, the pump 106 is in fluid communication with the piston chamber 308 at the first hydraulic port 318*a* and the second hydraulic port 318*b*. The pump 106 may be operated to actuate the ram piston 316 in the first direction 320*a* (e.g., forward stroke) by pumping hydraulic fluid to the first hydraulic port 318*a*, and actuate the ram piston 316 in the second direction 320*b* (e.g., return stroke) by pumping hydraulic fluid to the second hydraulic port 318*b*. By using a closed-loop hydraulic circuit to actuate the ram piston 316, a smaller hydraulic reservoir is required, as compared to a system having an open-loop hydraulic circuit.

The hydraulic circuit 400 may be configured to provide the fastest and most accurate motion control of the ram piston 316, thereby achieving the highest flow possible while maintaining a laminar flow profile that provides a constant flow rate. The precision level achieved of position and control of the ram piston 316 is directly proportional to the level of laminar flow rate achieved and is also directly proportional to the degree of reduced flow fluctuations and pressure pulses. The faster the ram piston 316 moves, the higher the flow rate of working fluid that is achieved.

In some embodiments, the ram piston 316 and the piston rod 306 provide a nominal area ratio of about 2:1 within the piston chamber 308 on opposing sides of the ram piston 306. In other words, the fluid volume on the rod end of the cylinder is approximately half that of the fluid volume on the blind end of the cylinder, due to the piston rod 306 taking up some of what would be fluid volume. Consequently, the ram piston 316 and the piston rod 306 occupy volume within the piston chamber 308 on one side of the ram piston 316 at a ratio of about 2:1 as compared to the volume of the piston chamber 308 on the opposite side of the ram piston 316. It is noted, however, that the 2:1 ratio is merely provided for illustrative purposes and, therefore, should not be considered limiting to the scope of the disclosure. Indeed, the cylinder assembly could be redesigned with a different area/volume ratio, without departing from the scope of the disclosure.

As the pump 106 delivers hydraulic fluid to the first hydraulic port 318*a* to extend the ram piston 316 and the interconnected piston rod 306 during a forward stroke, hydraulic fluid is simultaneously discharged from the chamber via the second hydraulic port 318*b* and conveyed to the pump 106. The volume of the hydraulic fluid received at the pump 106 from the second hydraulic port 318*b* makes the pump 106 flow deficient at a ratio of about 2:1. In conventional closed circuit hydraulic systems, a charge pump is commonly used to draw hydraulic fluid from a hydraulic fluid reservoir to make up for this oil volume required. In contrast, as the pump 106 delivers hydraulic fluid to the second hydraulic port 318*b* to retract the ram piston 316 during a return stroke, the pump 106 receives excess hydraulic fluid from the first hydraulic port 318*a* at a ratio of about 2:1. In conventional closed circuit hydraulic systems, the excess hydraulic fluid would commonly be directed to the hydraulic fluid reservoir through a pressure regulating device, such as a charge relief valve. In such applications, conveying the hydraulic fluid through the pressure relief valve generates excessive heat and circuit inefficiencies. When hydraulically driving a linear actuator, an open circuit system layout is typically utilized. This is mainly due to the different area ratio and volume ratio that exists on hydraulic cylinders. In an open circuit system, the flow sent out to an actuator to perform work is eventually sent back to the reservoir. There is no requirement for any oil to be returned back to the pump directly as is required in a closed circuit system.

According to embodiments of the present disclosure, the hydraulic circuit 400 is designed to counteract or neutralize the aforementioned inefficiencies of conventional, open circuit hydraulic systems. More specifically, the hydraulic circuit 400 includes an accumulator 402, a three-way, two-position valve 404 (hereafter referred to as a "3-2 valve 404"), and a charge pump 406. The accumulator 402 helps make up for energy losses in the hydraulic circuit 400. To help accomplish this, the accumulator 402 uses a gas pre-charge 408 (e.g., nitrogen, air, etc.) and essentially operates like a gas spring. The 3-2 valve 404 is in fluid communication with the accumulator 402 and may be configured to selectively direct hydraulic fluid to and from the accumulator 402 during operation, as needed.

A solenoid 410 and a spring return 412 help transition the 3-2 valve 404 between opposing first and second positions, which change how hydraulic fluid flows to/from the accumulator 402. More specifically, in a first position, as shown in FIG. 4, hydraulic fluid can flow from the accumulator 402 and through the 3-2 valve 404 in a first flow direction. Actuating the solenoid 410 moves the 3-2 valve 404 to a second position (not depicted) where hydraulic fluid can flow from the piston chamber 308 of the working pump assembly 112 to the accumulator 402 through the 3-2 valve 404 in a second flow direction opposite the first flow direction. Upon disengaging the solenoid 410, the spring return 412 urges the 3-2 valve 404 back to the first position.

The charge pump 406 may be a fixed-displacement hydraulic pump in fluid communication with the hydraulic fluid reservoir 108. In operation, the charge pump 406 may help make up for a deficiency of hydraulic fluid that might occur in the hydraulic circuit 400 during operation.

Example operation of the hydraulic circuit 400 is now provided. A forward stroke of the ram piston 316 and the piston rod 306 in the first direction 320*a* is caused by hydraulic fluid being pumped from the pump 106 to the first hydraulic port 318*a*, as shown by the arrow A1. The forward stroke of the ram piston 316 will correspondingly and simultaneously force hydraulic fluid out of the piston chamber 308 on the opposite side of the ram piston 316 via the second hydraulic port 318*b*, as shown by the arrow A2. The discharged hydraulic fluid will be conveyed back to the pump 106, as shown by the arrow A3.

Since the area ratio on opposing sides of the ram piston 306 within the piston chamber 308 is not equal (e.g., 2:1), the volume of the hydraulic fluid discharged from the piston chamber 308 via the second hydraulic port 318*b* will be less than the volume of hydraulic fluid introduced into the piston chamber 308 at the first hydraulic port 318*a*, thus making the pump 106 flow deficient during the forward stroke. To account for this hydraulic fluid deficiency, a stored amount of hydraulic fluid may be released from the accumulator 402 under pressure provided by the gas pre-charge 408, as shown by the arrow A4, and directed to the pump 106 via the 3-2 valve 404 in the first position, as shown by the arrow A5. In some embodiments, the charge pump 406 may pump additional hydraulic fluid to the pump 106 to further make up for flow deficiency in the hydraulic circuit 400 caused by the different area ratio in the piston chamber 308.

During a return stroke of the ram piston 316 and the piston rod 306, hydraulic fluid is pumped from the pump 106 to the second hydraulic port 318*b*, as shown by the arrows B1 and B2. In some embodiments, as illustrated, a charge pressure regulating device 414 may interpose the pump 106 and the charge pump 406, thus preventing the hydraulic fluid from being conveyed to the charge pump 406 during this operation. The charge pressure regulating device 414 may be, for example, a type of check valve or relief valve. The charge pressure regulating device 414 may also selectively permit additional hydraulic fluid to be pumped toward the pump 106 or the piston chamber, as needed during operation. As the ram piston 316 retracts during the return stroke, hydraulic fluid is simultaneously discharged from the piston chamber 308 via the first hydraulic port 318*a* and conveyed to the pump 106, as shown by the arrow B3.

Since the area ratio on opposing sides of the ram piston 306 within the piston chamber 308 is not equal (e.g., 2:1), the volume of the hydraulic fluid discharged via the first hydraulic port 318*b* will be more than the volume of hydraulic fluid introduced into the piston chamber 308 at the second hydraulic port 318*b*, such as at a rate of two or more times too much. Instead of directing this excess flow to the hydraulic fluid reservoir 108, as would be typically done in conventional hydraulic fluid circuits, the excess hydraulic fluid may be directed to the accumulator 402 via the 3-2 valve 404, as shown at the arrows B4 and B5. To accomplish this, the solenoid 410 may be actuated to transition the 3-2 valve 404 to the second position. When in the second position, the 3-2 valve 404 conveys the excess hydraulic fluid to the accumulator 402 in the second flow direction to charge the accumulator 402 by building up energy in the gas pre-charge 408 that can subsequently be used in the next forward stroke cycle.

The charge pump 406 pumps additional hydraulic fluid from the hydraulic fluid reservoir 108 during normal operation, as shown at arrow B6. During the return stroke, additional hydraulic fluid is pumped from the charge pump 406 and discharged across a pressure regulating device 416 to help cool the hydraulic oil. During the forward stroke, additional hydraulic fluid is conveyed across the charge pressure regulating device 314 and used to supplement the hydraulic fluid received at the pump 106, as at the arrows A2 and A3. Alternatively, during the forward stroke, the additional hydraulic fluid may be used to supplement the hydraulic fluid used to charge the accumulator 402, as at the arrows B4 and B5. Depending on the fluid pressure seen on either side of the charge check valve 416 in the charge circuit, additional hydraulic fluid is capable of being conveyed to either side of the hydraulic circuit 400 at all times.

The hydraulic circuit 400 may be operated through a control system 418 communicably coupled (wired or wirelessly) to one or more component devices of the hydraulic circuit 400. The control system 418 can have at least one processor configured to control operation of the pump 106, the accumulator 402, the 3-2 valve 404, and the charge pump 406. Accordingly, the control system 418 may be configured to control the flowrate and/or direction of the hydraulic fluid flowing within the hydraulic circuit 400.

In some embodiments, the control system 418 may comprise or form part of a real-time diagnostics monitoring system. In such embodiments, the control system may be in communication with various types of sensors and/or gauges configured to provide real-time feedback on the operational condition of the hydraulic circuit 400. For instance, the control system 418 may be communicably coupled to one or more sensors 420 configured to collect data indicative of the position of the ram piston 316 relative to the ram cylinder 202 (FIGS. 2B and 3). In such embodiments, the length and rate of the forward and return strokes of the ram piston 316 can be adjusted by the control system 418, which can vary the pressure and/or the rate at which hydraulic fluid is delivered to and removed from the piston chamber 308. The length and rate of the forward and return strokes of the ram piston 316 may also be adjusted to increase pump efficiency and/or reduce cyclic fatigue. In other examples, the hydraulic circuit 400 may include one or more contamination sensors (not shown) strategically placed to monitor the real-time cleanliness level and water saturation level of the hydraulic fluid. Also, one or more temperature transducers, flow meters, pressure transducers, vibration monitors, and other devices may be incorporated into the hydraulic circuit to enable real-time monitoring of system performance and degradation. These same sensors also allow for long term aggregate modeling to build preventative maintenance schedules, predictive failure analysis, etc.

Functionality of the hydraulic circuit 400 can be realized at varying levels of efficiency. The working pump assembly 112, the accumulator 402, and the 3-2 valve 404 may be integrated into a single assembly, thus reducing and minimizing pressure loss, overall size and weight, number of leak points, etc. The 3-2 valve 404 in the hydraulic circuit 400 may be designed and manufactured to required specifications for both minimal pressure drop and fast shifting speed. The pressure drop through the 3-2 valve 404 is critical to the overall system efficiency, and reduced pressure drop achieved through the 3-2 valve 404 equates to reduced horsepower required to perform the return stroke.

The shifting speed of the 3-2 valve 404 has a direct impact on the number of hydraulic cylinder cycles that can be achieved in a given amount of time. The combination of shifting speed and pressure drop through the 3-2 valve 404 can impact the speed at which the ram piston 316 can accelerate and decelerate without causing damage to the hydraulic pump. Because optimal laminar flow from a contributory pumping apparatus is only achieved through a precise motion profile sequence, the overall efficiency of the hydraulic circuit 400 may precisely determine the maximum acceleration and deceleration values of the hydraulic cylinders during both forward and return strokes. The acceleration and deceleration profile on the forward stroke of the ram piston 316 can be viewed as periods not at 100% flow rate, or commanded cylinder speed. Therefore, the more time spent at commanded cylinder speed (i.e. not accelerating or decelerating) the more productive the machine becomes. These would not be considered inefficiencies in regards to wasted horsepower or heat generation as it is more a factor of uptime.

Figure 5:
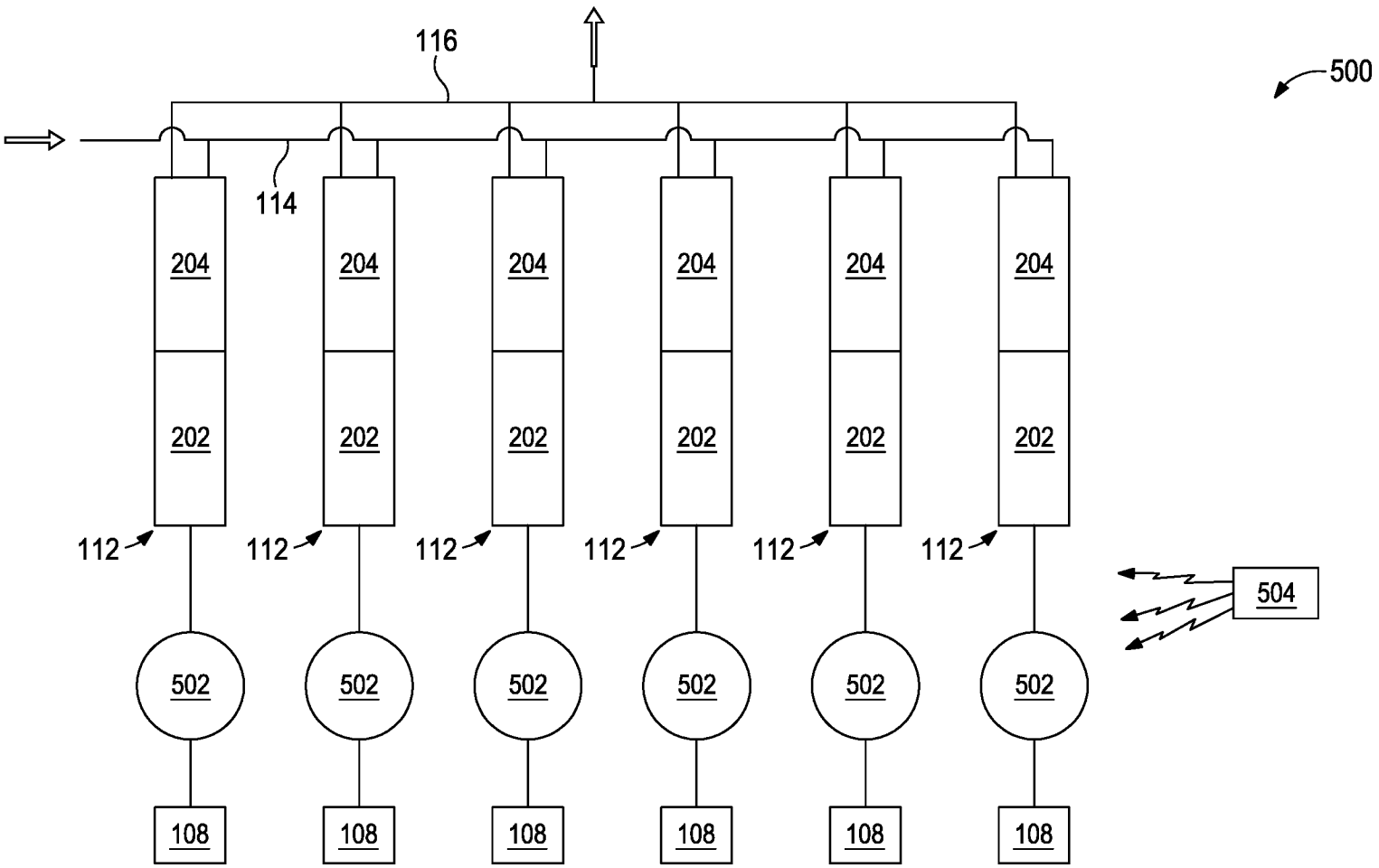
FIG. 5 is a schematic diagram of another example well service pump system, according to one or more embodiments of the present disclosure.

FIG. 5 is a schematic diagram of another example well service pump system 500, according to one or more embodiments of the present disclosure. The well service pump system 500 (referred to hereafter as "the pump system 500") may be the same as or similar to the pump system 100 of FIGS. 1A-1B and 2A-2B and therefore may be best understood with reference thereto, where like numerals will represent like components not described again in detail. Similar to the pump system 100, for example, the pump system 500 may be mobile, meaning that it can be mounted to or supported by the trailer 102 (FIGS. 1A-1B) for both operation and transport, or the pump system 500 may otherwise be mounted to a skid frame that can be loaded and offloaded from a transport vehicle. Moreover, the pump system 500 may include a plurality of working pump assemblies 112, and each working pump assembly 112 includes the hydraulic ram cylinder 202 and the working fluid end cylinder 204, as generally described herein. During operation of the working pump assemblies 112, a working fluid is drawn into the working fluid end cylinder 204 from the suction manifold 114, and a compressed working fluid is discharged from the working fluid end cylinder 204 via the discharge manifold 116, as also described herein.

The pump system 500 further includes independent and discrete closed-loop hydraulic circuits 502 in fluid communication with each working pump assembly 112 and, more particularly, with the hydraulic ram cylinder 202 of each working pump assembly 112. The closed-loop hydraulic circuit 502 may be the same as or similar to the hydraulic circuit 400 of FIG. 4 and therefore may be best understood with reference thereto, where like numerals will correspond to like components not described again in detail. Similar to the hydraulic circuit 400, for example, each hydraulic circuit 502 in the pump system 500 may include the pump 106 (FIG. 4) in fluid communication with the piston chamber of the hydraulic ram cylinder 202, the accumulator 402 (FIG. 4) in fluid communication with the pump and the hydraulic ram cylinder 202, the 3-2 valve 404 (FIG. 4), and the charge pump 406 (FIG. 4). Moreover, each closed-loop hydraulic circuit 502 includes a discrete and segregated hydraulic fluid reservoir 108 in fluid communication with the corresponding charge pump 406. Operation of each hydraulic circuit 502 may be the same as described above with reference to the hydraulic circuit 400 and, therefore, will not be described again.

In some embodiments, the pump system 500 may further include a master control system 504 programmed to control operation of the pump system 500. The master control system 504 can have at least one processor configured to control operation of the pump 106 (FIG. 4), the accumulator 402 (FIG. 4), the 3-2 valve 404 (FIG. 4), and the charge pump 406 of each hydraulic circuit 502. In some embodiments, the master control system 504 may be communicably coupled (wired or wirelessly) to one or more of the component devices of each hydraulic circuit 502. In other embodiments, however, the master control system 504 may alternatively be communicably coupled (wired or wirelessly) to the independent control system 418 (FIG. 4) of each hydraulic circuit 502. Accordingly, the master control system 504 may be configured to control the flowrate and/or direction of the hydraulic fluid flowing within each hydraulic circuit 500, and thereby control the overall output of the compressed working fluid via the discharge manifold 116.

While the pump system 500 is depicted as including six working pump assemblies 112 and a corresponding six closed-loop hydraulic circuits 502, the pump system 500 may alternatively include more or less than six, without departing from the scope of the disclosure.

Accordingly, the pump system 500 includes a plurality of individual and discrete systems that can be independently or jointly operated in producing the compressed working fluid. Each working pump assembly and corresponding closed-loop hydraulic circuit 502 works independently of the others in the pump system 500. Moreover, each hydraulic circuit 502 fluidly communicates with a segregated and separate hydraulic fluid reservoir 108. Consequently, no component or part in one combination working pump assembly 112 and hydraulic circuit 502 is dependent on a component or part of another combination working pump assembly 112 and hydraulic circuit 502 in the pump system 500. As will be appreciated, this provides a degree of redundancy in the pump system 500 that allows one working pump assembly 112 to be shut down or fail without affecting the others. Rather, the other working pump assemblies 112 are able to operate normally in the event catastrophic failure or maintenance shut down is required for one working pump assembly 112. This provides an operator with a controlled failure mode for the pump system 500.

Embodiments disclosed herein include:

A. A closed-loop hydraulic circuit includes a piston chamber housing a piston rod and a ram piston coupled to an end of the piston rod, a pump in fluid communication with the piston chamber at first and second hydraulic ports, wherein pumping a hydraulic fluid to the first hydraulic port causes a forward stroke of the ram piston and the piston rod within the piston chamber, and pumping the hydraulic fluid to the second hydraulic port causes a return stroke of the ram piston and the piston rod within the piston chamber, an accumulator in fluid communication with the pump and the piston chamber, and a three-way, two-position valve (3-2 valve) actuatable between a first position, where pressurized hydraulic fluid is conveyed from the accumulator to the pump during the forward stroke, and a second position, where excess hydraulic fluid is conveyed from the first hydraulic port to the accumulator during the return stroke.

B. A well service pump system that includes a working pump assembly that includes a working fluid end cylinder having a plunger rod movably disposed therein, and a ram cylinder coupled to the working fluid end cylinder and having a piston rod movably disposed therein, wherein a ram piston is coupled to an end of the piston rod and the piston rod is coupled to the plunger rod. The well service pump system further including a closed-loop hydraulic circuit in fluid communication with the ram cylinder to move the ram piston and the piston rod within the ram cylinder and thereby move the plunger rod within the working fluid end cylinder, the hydraulic circuit including a pump in fluid communication with the ram cylinder at first and second hydraulic ports, wherein pumping a hydraulic fluid to the first hydraulic port with the pump causes a forward stroke of the ram piston and the piston rod within the ram cylinder, and pumping the hydraulic fluid to the second hydraulic port with the pump causes a return stroke of the ram piston and the piston rod within the ram cylinder, an accumulator in fluid communication with the pump and the ram cylinder, and a three-way, two-position valve (3-2 valve) actuatable between a first position, where pressurized hydraulic fluid is conveyed from the accumulator to the pump during the forward stroke, and a second position, where excess hydraulic fluid is conveyed from the first hydraulic port to the accumulator during the return stroke.

C. A well service pump system that includes a plurality of working pump assemblies, each working pump assembly including a working fluid end cylinder operatively coupled to a ram cylinder, a plurality of closed-loop hydraulic circuits, each closed-loop hydraulic circuit being in fluid communication a corresponding one of the plurality of working pump assemblies, wherein each hydraulic circuit includes a pump in fluid communication with the ram cylinder to pump a hydraulic fluid that causes forward and return strokes of a ram piston movably arranged within the ram cylinder, an accumulator in fluid communication with the pump and the ram cylinder, a three-way, two-position valve (3-2 valve) actuatable between a first position, where pressurized hydraulic fluid is conveyed from the accumulator to the pump during the forward stroke, and a second position, where excess hydraulic fluid is conveyed from the first hydraulic port to the accumulator during the return stroke; and a charge pump in fluid communication with pump and the ram cylinder. The well service pump system further including a plurality of hydraulic fluid reservoirs, wherein each hydraulic fluid reservoir is segregated from other hydraulic fluid reservoirs and in fluid communication with the charge pump of a corresponding one of the plurality of hydraulic circuits.

Each of embodiments A, B, and C may have one or more of the following additional elements in any combination: Element 1: wherein the ram piston and the piston rod exhibit an area ratio of 2:1. Element 2: further comprising a charge pump in fluid communication with pump and the piston chamber to convey additional hydraulic fluid to the pump during the forward stroke. Element 3: further comprising a charge pressure regulating device interposing the pump and the charge pump. Element 4: wherein the accumulator includes a gas pre-charge that is charged upon receiving the excess hydraulic fluid during the return stroke, and the gas pre-charge is discharged by releasing the pressurized hydraulic fluid to the pump during the forward stroke. Element 5: wherein the 3-2 valve comprises a solenoid operable to move the 3-2 valve to the first position, and a spring return that moves the 3-2 valve to the second position upon disengaging the solenoid. Element 6: further comprising a control system in communication with one or more of the pump, the accumulator, and the 3-2 valve to control a flowrate and direction of the hydraulic fluid within the hydraulic circuit. Element 7: wherein the control system is further in communication with one or more sensors positioned to collect data indicative of a position of the ram piston within the piston chamber, wherein the control system is programmed to adjust a length and rate of the forward and return strokes based on the position of the ram piston within the piston chamber.

Element 8: further comprising a suction manifold in fluid communication with the working fluid end cylinder to provide a working fluid into the working fluid end cylinder during the return stroke, and a discharge manifold in fluid communication with the working fluid end cylinder to discharge a compressed working fluid from the working fluid end cylinder during the forward stroke. Element 9: wherein the ram piston and the piston rod exhibit an area ratio of 2:1. Element 10: wherein the hydraulic circuit further includes a charge pump in fluid communication with pump and the ram cylinder to convey additional hydraulic fluid to the pump during the forward stroke. Element 11: wherein the accumulator includes a gas pre-charge that is charged upon receiving the excess hydraulic fluid during the return stroke, and the gas pre-charge is discharged by releasing the pressurized hydraulic fluid to the pump during the forward stroke. Element 12: wherein the 3-2 valve comprises a solenoid operable to move the 3-2 valve to the first position, and a spring return that moves the 3-2 valve to the second position upon disengaging the solenoid. Element 13: further comprising a control system in communication with one or more of the pump, the accumulator, and the 3-2 valve to control a flowrate and direction of the hydraulic fluid within the hydraulic circuit. Element 14: wherein the control system is further in communication with one or more sensors positioned to collect data indicative of a position of the ram piston within the piston chamber, and wherein the control system is programmed to adjust a length and rate of the forward and return strokes based on the position of the ram piston within the piston chamber.

Element 15: further comprising a suction manifold in fluid communication with the working fluid end cylinder of each working pump assembly to provide a working fluid into the working fluid end cylinder during the return stroke, and a discharge manifold in fluid communication with the working fluid end cylinder of each working pump assembly to discharge a compressed working fluid from the working fluid end cylinder during the forward stroke. Element 16: further comprising a master control system in communication with each hydraulic circuit to control a flowrate and direction of the hydraulic fluid within each hydraulic circuit. Element 17: wherein the plurality of working pump assemblies, the plurality of hydraulic circuits, and the plurality of hydraulic fluid reservoirs are each mounted to or supported by a trailer for both operation and transport.

By way of non-limiting example, exemplary combinations applicable to A, B, and C include: Element 2 with Element 3; Element 6 with Element 7; and Element 13 with Element 14.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A closed-loop hydraulic circuit, comprising:

a piston chamber housing a piston rod and a ram piston coupled to an end of the piston rod;

a pump in fluid communication with the piston chamber at first and second hydraulic ports, wherein pumping a hydraulic fluid to the first hydraulic port causes a forward stroke of the ram piston and the piston rod within the piston chamber, and pumping the hydraulic fluid to the second hydraulic port causes a return stroke of the ram piston and the piston rod within the piston chamber;

an accumulator in fluid communication with the pump and the piston chamber; and a three-way, two-position valve (3-2 valve) actuatable between a first position, where pressurized hydraulic fluid is conveyed from the accumulator to the pump during the forward stroke, and a second position, where excess hydraulic fluid is conveyed from the first hydraulic port to the accumulator during the return stroke.

2. The hydraulic circuit of claim 1, wherein the ram piston and the piston rod exhibit a nominal area ratio of 2:1.

3. The hydraulic circuit of claim 1, further comprising a charge pump in fluid communication with pump and the piston chamber to convey additional hydraulic fluid to the pump during the forward stroke.

4. The hydraulic circuit of claim 3, further comprising a charge pressure regulating device interposing the pump and the charge pump.

5. The hydraulic circuit of claim 1, wherein the accumulator includes a gas pre-charge that is charged upon receiving the excess hydraulic fluid during the return stroke, and the gas pre-charge is discharged by releasing the pressurized hydraulic fluid to the pump during the forward stroke.

6. The hydraulic circuit of claim 1, wherein the 3-2 valve comprises:

a solenoid operable to move the 3-2 valve to the first position; and a spring return that moves the 3-2 valve to the second position upon disengaging the solenoid.

7. The hydraulic circuit of claim 1, further comprising a control system in communication with one or more of the pump, the accumulator, and the 3-2 valve to control a flowrate and direction of the hydraulic fluid within the hydraulic circuit.

8. The hydraulic circuit of claim 7, wherein the control system is further in communication with one or more sensors positioned to collect data indicative of a position of the ram piston within the piston chamber, wherein the control system is programmed to adjust a length and rate of the forward and return strokes based on the position of the ram piston within the piston chamber.

9. A well service pump system, comprising:

a working pump assembly that includes:

a working fluid end cylinder having a plunger rod movably disposed therein; and a ram cylinder coupled to the working fluid end cylinder and having a piston rod movably disposed therein, wherein a ram piston is coupled to an end of the piston rod and the piston rod is coupled to the plunger rod; and a closed-loop hydraulic circuit in fluid communication with the ram cylinder to move the ram piston and the piston rod within the ram cylinder and thereby move the plunger rod within the working fluid end cylinder, the hydraulic circuit including:

a pump in fluid communication with the ram cylinder at first and second hydraulic ports, wherein pumping a hydraulic fluid to the first hydraulic port with the pump causes a forward stroke of the ram piston and the piston rod within the ram cylinder, and pumping the hydraulic fluid to the second hydraulic port with the pump causes a return stroke of the ram piston and the piston rod within the ram cylinder;

an accumulator in fluid communication with the pump and the ram cylinder; and a three-way, two-position valve (3-2 valve) actuatable between a first position, where pressurized hydraulic fluid is conveyed from the accumulator to the pump during the forward stroke, and a second position, where excess hydraulic fluid is conveyed from the first hydraulic port to the accumulator during the return stroke.

10. The well service pump system of claim 9, further comprising:

a suction manifold in fluid communication with the working fluid end cylinder to provide a working fluid into the working fluid end cylinder during the return stroke; and a discharge manifold in fluid communication with the working fluid end cylinder to discharge a compressed working fluid from the working fluid end cylinder during the forward stroke.

11. The well service pump system of claim 9, wherein the ram piston and the piston rod exhibit a nominal area ratio of 2:1.

12. The well service pump system of claim 9, wherein the hydraulic circuit further includes a charge pump in fluid communication with pump and the ram cylinder to convey additional hydraulic fluid to the pump during the forward stroke.

13. The well service pump system of claim 9, wherein the accumulator includes a gas pre-charge that is charged upon receiving the excess hydraulic fluid during the return stroke, and the gas pre-charge is discharged by releasing the pressurized hydraulic fluid to the pump during the forward stroke.

14. The well service pump system of claim 9, wherein the 3-2 valve comprises:

a solenoid operable to move the 3-2 valve to the first position; and a spring return that moves the 3-2 valve to the second position upon disengaging the solenoid.

15. The well service pump system of claim 9, further comprising a control system in communication with one or more of the pump, the accumulator, and the 3-2 valve to control a flowrate and direction of the hydraulic fluid within the hydraulic circuit.

16. The well service pump system of claim 15, wherein the control system is further in communication with one or more sensors positioned to collect data indicative of a position of the ram piston within the piston chamber, and wherein the control system is programmed to adjust a length and rate of the forward and return strokes based on the position of the ram piston within the piston chamber.

17. A well service pump system, comprising:

a plurality of working pump assemblies, each working pump assembly including a working fluid end cylinder operatively coupled to a ram cylinder;

a plurality of closed-loop hydraulic circuits, each closed-loop hydraulic circuit being in fluid communication a corresponding one of the plurality of working pump assemblies, wherein each closed-loop hydraulic circuit includes:

a pump in fluid communication with the ram cylinder to pump a hydraulic fluid that causes forward and return strokes of a ram piston movably arranged within the ram cylinder;

an accumulator in fluid communication with the pump and the ram cylinder;

a three-way, two-position valve (3-2 valve) actuatable between a first position, where pressurized hydraulic fluid is conveyed from the accumulator to the pump during the forward stroke, and a second position, where excess hydraulic fluid is conveyed from the first hydraulic port to the accumulator during the return stroke; and a charge pump in fluid communication with the pump and the ram cylinder; and a plurality of hydraulic fluid reservoirs, wherein each hydraulic fluid reservoir is segregated from other hydraulic fluid reservoirs and in fluid communication with the charge pump of a corresponding one of the plurality of closed-loop hydraulic circuits.

18. The well service pump system of claim 17, further comprising:

a suction manifold in fluid communication with the working fluid end cylinder of each working pump assembly to provide a working fluid into the working fluid end cylinder during the return stroke; and a discharge manifold in fluid communication with the working fluid end cylinder of each working pump assembly to discharge a compressed working fluid from the working fluid end cylinder during the forward stroke.

19. The well service pump system of claim 17, further comprising a master control system in communication with each closed-loop hydraulic circuit to control a flowrate and direction of the hydraulic fluid within each closed-loop hydraulic circuit.

20. The well service pump system of claim 17, wherein the plurality of working pump assemblies, the plurality of closed-loop hydraulic circuits, and the plurality of hydraulic fluid reservoirs are each mounted to or supported by a trailer for both operation and transport.

* * * * *